US010302036B2

(12) United States Patent
Larocca

(10) Patent No.: US 10,302,036 B2
(45) **Date of Patent: *May 28, 2019**

(54) COMPUTER PROGRAM FOR OPERATING AN INTERNAL COMBUSTION ENGINE

(71) Applicant: GM GLOBAL TECHNOLOGY OPERATIONS LLC, Detroit, MI (US)

(72) Inventor: Matteo Larocca, Roma (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 327 days.

This patent is subject to a terminal disclaimer.

(21) Appl. No.: 15/177,981

(22) Filed: Jun. 9, 2016

(65) Prior Publication Data

US 2016/0363075 A1 Dec. 15, 2016

(30) Foreign Application Priority Data

Jun. 11, 2015 (DE) ..... 20 2015 004 194 U

(51) Int. Cl.
*F01N 3/08* (2006.01)
*F01N 3/20* (2006.01)
(Continued)

(52) U.S. Cl.
CPC ..... *F02D 41/1454* (2013.01); *F02D 41/1456* (2013.01); *F02D 41/1458* (2013.01);
(Continued)

(58) Field of Classification Search
CPC .. F02D 41/1454; F02D 41/26; F02D 41/1456; F02D 41/2441; F02D 41/1458;
(Continued)

(56) References Cited

U.S. PATENT DOCUMENTS 5,764,552 A * 6/1998 Walter ..... H03H 21/0012 708/322
5,915,359 A * 6/1999 Meyer ..... F02D 41/1405 123/436

(Continued)

FOREIGN PATENT DOCUMENTS

DE 10208424 A1 10/2002
DE 102004038389 A1 3/2006
WO 2013029878 A1 3/2013

OTHER PUBLICATIONS

German Patent Office, German Search Report for German Application No. 202015004194.9, dated Oct. 28, 2015.

*Primary Examiner* — Sizo B Vilakazi
*Assistant Examiner* — Brian R Kirby
(74) *Attorney, Agent, or Firm* — Lorenz & Kopf, LLP

(57) ABSTRACT

A method and apparatus for operating an internal combustion engine is disclosed. A signal generated by the oxygen concentration sensor is converted into a first signal indicative of an air/fuel ratio in the engine cylinder. A second signal indicative of an expected air/fuel ratio in the engine cylinder due to a fuel injection is generated and filtered to obtain a filtered signal and used to operate the engine. The filtered signal is obtained by sampling values of the first and second signals. A time constant is calculated based on the sampled values of the first and second signals and a value of the first signal sampled during a preceding control cycle. A value of the filtered signal is calculated based on the calculated time constant, the sampled value of the second signal and a value of the filtered signal calculated during the preceding control cycle.

11 Claims, 2 Drawing Sheets

(51) Int. Cl.

| | |
|---|---|
| ***F02D 41/00*** | (2006.01) |
| ***F02D 41/14*** | (2006.01) |
| ***F02D 41/24*** | (2006.01) |
| ***F02D 41/26*** | (2006.01) |
| ***F02D 41/28*** | (2006.01) |
| *F02D 41/38* | (2006.01) |

(52) U.S. Cl.
CPC ..... *F02D 41/2441* (2013.01); *F02D 41/26* (2013.01); *F01N 3/0814* (2013.01); *F01N 3/2066* (2013.01); *F01N 2560/025* (2013.01); *F01N 2560/026* (2013.01); *F02D 41/0007* (2013.01); *F02D 41/1482* (2013.01); *F02D 41/1483* (2013.01); *F02D 41/247* (2013.01); *F02D 2041/1432* (2013.01); *F02D 2041/389* (2013.01)

(58) Field of Classification Search
CPC ..... F02D 41/247; F02D 2041/1432; F02D 41/1483; F02D 41/1482; F01N 2560/026; F01N 3/2066; F01N 3/0814; F01N 2560/025
USPC ..... 701/101–105
See application file for complete search history.

(56) References Cited

U.S. PATENT DOCUMENTS 6,003,309 A * 12/1999 Agustin ..... F01N 3/2053 60/276
6,712,053 B2 * 3/2004 Kobayashi ..... F02D 23/02 123/568.19
7,805,256 B2 * 9/2010 Frodl ..... G01N 21/3504 250/565
7,997,070 B2 * 8/2011 Yasui ..... F01N 3/208 60/276
2003/0070423 A1 * 4/2003 Morinaga ..... F01N 3/2006 60/284
2003/0116150 A1 * 6/2003 Kobayashi ..... F02D 23/02 123/674
2006/0236990 A1 * 10/2006 Annoura ..... F02D 41/008 123/673
2007/0261671 A1 * 11/2007 Nakagawa ..... F02D 35/023 123/435
2008/0114552 A1 * 5/2008 Frodl ..... G01N 21/3504 702/24
2010/0031731 A1 * 2/2010 Kawase ..... G01N 27/4065 73/23.32
2010/0211290 A1 * 8/2010 Kidokoro ..... F02D 41/1408 701/103
2012/0024273 A1 * 2/2012 Iwazaki ..... F02D 41/0085 123/703
2013/0103285 A1 * 4/2013 Zimmerschied .... F02D 41/1402 701/102
2013/0268177 A1 * 10/2013 Wu ..... F02D 41/0085 701/103
2014/0122020 A1 * 5/2014 Kowalkowski ..... G06F 17/18 702/179
2014/0238368 A1 * 8/2014 Jammoussi ..... F02D 41/30 123/672
2014/0358355 A1 * 12/2014 Zimmerschied .... F02D 41/1495 701/31.1
2015/0013442 A1 * 1/2015 Michalske ..... F02D 41/1454 73/114.71
2015/0039256 A1 * 2/2015 Michalske ..... F02D 41/1454 702/104
2015/0047415 A1 * 2/2015 Michalske ..... F02D 41/1454 73/23.31
2015/0068505 A1 * 3/2015 Iwase ..... F02D 41/008 123/673
2015/0143884 A1 * 5/2015 Heaton ..... F01N 3/2066 73/114.75

* cited by examiner

COMPUTER PROGRAM FOR OPERATING AN INTERNAL COMBUSTION ENGINE

CROSS-REFERENCE TO RELATED APPLICATION

This application claims priority to German Patent Application No. 202015004194.9, filed Jun. 11, 2015, which is incorporated herein by reference in its entirety.

TECHNICAL FIELD

The present disclosure pertains to a computer program for operating an internal combustion engine, for example an internal combustion engine of a motor vehicle. More particularly, the present disclosure relates to a computer program for generating a signal indicative of an air/fuel ratio within the engine cylinders.

BACKGROUND

It is known that an internal combustion engine of a motor vehicle includes at least a fuel injector for injecting a metered quantity of fuel into an engine cylinder, an intake valve for allowing an air quantity to mix with the fuel into the cylinder, and an exhaust valve for discharging the exhaust gas produced by the combustion of the air/fuel mixture inside the cylinder. The exhaust valve is in fluid communication with an aftertreatment system including an exhaust pipe and an oxygen concentration sensor (e.g. a lambda sensor or a nitrogen oxides $NO_x$ sensor) disposed in the exhaust pipe. The oxygen concentration sensor generates a signal (i.e. an electric signal) indicative of the oxygen concentration in the exhaust gas, which may be converted by an electronic control unit into a first signal representative of the air/fuel ratio of the mixture within the engine cylinder.

The electronic control unit may be also configured to generate a second signal representative of an expected air/fuel ratio inside the engine cylinder, which is not based on the signal coming from oxygen concentration sensor but estimated on the basis of the fuel injected quantity and on the air quantity delivered into the engine. This second signal is generally used to start many different control strategies of the internal control engine, in particular control strategies that make use of the aforementioned oxygen concentration sensor.

As a consequence, the reliability of these strategies generally depends on how the second signal generated by the electronic control unit actually adheres to the first signal generated with the aid of the oxygen concentration sensor.

SUMMARY

In accordance with the present disclosure, a solution is provided for adapting a second signal generated by the electronic control unit to a first signal is generated on the basis of the real response of an oxygen concentration sensor (e.g. a lambda sensor or a $NO_x$ sensor), as it varies during the lifetime of the internal combustion engine in a simple, rational and rather inexpensive solution.

In particular, an embodiment of the present disclosure provides a computer program for operating an internal combustion engine having a fuel injector for injecting fuel into an engine cylinder, an exhaust pipe for discharging exhaust gas from the engine cylinder, and an oxygen concentration sensor (e.g. a lambda sensor or a NOx sensor) disposed in the exhaust pipe. A non-transitory computer readable medium includes a computer program having computer code, which when run on a computer, is configured to convert a signal generated by the oxygen concentration sensor into a first signal indicative of an air/fuel ratio in the engine cylinder, operate the fuel injector to perform a fuel injection, generate a second signal indicative of an expected air/fuel ratio in the engine cylinder due to the fuel injection, filter the second signal to obtain a filtered signal, and using the filtered signal to operate the engine.

The filtered signal is obtained by periodically performing a control cycle including sampling a value of the first signal, sampling a value of the second signal, calculating a time constant as a function of the sampled value of the first signal, the sampled value of the second signal, and a value of the first signal sampled during a preceding control cycle, and calculating a value of the filtered second signal as a function of the calculated time constant, the sampled value of the second signal and a value of the filtered signal calculated during the preceding control cycle. As a result, the time constant used to filter the second signal (i.e. the raw signal generated by the electronic control unit) is adjusted cycle-by-cycle on the basis of the real values of the air/fuel ratio measured by the oxygen concentration sensor, thereby automatically adapting and phasing the filtered signal generated by the electronic control unit with the signal of the oxygen concentration sensor.

According to an aspect of the solution, the value of the filtered signal may be calculated with the following equation:

$$x_{2if} = e^{-\frac{T}{\tau}} \cdot x_{2(i-1)f} + \left(1 - e^{-\frac{T}{\tau}}\right) \cdot x_{2i}$$

Wherein:

$\tau$ is the time constant, $x_{2if}$ is the value of the filtered signal, $x_{2(i-1)f}$ is the value of the filtered signal calculated during the preceding control cycle, $x_{2i}$ is the sampled value of the second signal, and T is a time period between two consecutive control cycles.

This aspect provides for calculating the value of the filtered signal with a so-called exponential filter, which is a simple and reliable solution for applying a first order filter to a signal.

According to another aspect of the solution, the time constant may be calculated with the following equation:

$$\tau = \frac{T}{\log \frac{x_{1i} - x_{2i}}{x_{1(i-1)} - x_{2i}}}$$

Wherein:

$\tau$ is the time constant, $x_{1i}$ is the sampled value of first signal, $x_{1(i-1)}$ is the sampled value of the first signal during the preceding control cycle, $x_{2i}$ is the sampled value of the second signal, and T is a time period between two consecutive control cycles.

This aspect provides a reliable solution for calculating the time constant to be used in the filter.

Another aspect of the solution provides that the computer program may include program code, which when run on a computer, is configured to start a closed-loop control strategy of a fuel injected quantity, as the value of filtered signal exceeds a predetermined threshold value thereof. Taking advantage of the reliability of the filtered signal provided by the present solution, this aspect allows to timely activate the above mentioned closed-loop control strategy, which may be useful to prevent the generation of smoke and/or to properly execute a regeneration process of an aftertreatment device (for example of the LNT), in particular, this closed-loop control strategy may generally include calculating a difference between the first signal (generated with the aid of the oxygen concentration sensor) and a target value thereof, using the calculated difference as an input of a controller, for example a proportional-integrative (PI) or a proportional-integrative-derivative (PID) controller, and using the output of the controller to adjust a fuel quantity injected by the fuel injection.

According to another aspect of the present disclosure, the computer program may include program code, which when run on a computer, is configured to start a learning procedure of a fuel injected quantity, as the value of the filtered signal exceeds a predetermined threshold value thereof. Taking advantage of the reliability of the filtered signal provided by the present solution, this aspect allows timely activation of the above mentioned learning procedure, which may be useful to correct one or more operation parameters of the fuel injector. This learning procedure may generally include the step of using the first signal (generated with the aid of the oxygen concentration sensor) to estimate the fuel quantity that has been injected by means of a test fuel injection performed during an engine cut off.

According to another aspect of the present disclosure, the computer program may include program code, which when run on a computer, is configured to start a diagnostic strategy of an aftertreatment device located in the exhaust pipe upstream of the oxygen concentration sensor (for example the LNT), as the value of the filtered signal exceeds a predetermined threshold value thereof. Taking advantage of the reliability of the filtered signal provided by the present solution, this aspect allows timely activation of the above mentioned diagnostic strategy, which may be useful to warn the driver about possible faults of the aftertreatment device. This diagnostic strategy may generally include calculating a difference between the first signal (generated with the aid of the oxygen concentration sensor) and a set-point value thereof, and identify a fault of the aftertreatment device if the calculated difference exceeds a predetermined threshold value thereof.

The proposed solution may be carried out in the form of a computer program product including a carrier and the computer program residing on the carrier. The solution can be also embodied as an electromagnetic signal, the signal being modulated to carry a sequence of data bits which represent the computer program.

The solution can be also embodied as an internal combustion engine including a fuel injector for injecting fuel into an engine cylinder, an exhaust pipe for discharging exhaust gas from the engine cylinder, an oxygen concentration sensor disposed in the exhaust pipe for generating a first signal indicative of a variation of an air/fuel ratio in the engine cylinder, and an electronic control unit configured to execute the computer program.

Another embodiment of the present disclosure provides a method of operating an internal combustion engine including a fuel injector for injecting fuel into an engine cylinder, an exhaust pipe for discharging exhaust gas from the engine cylinder and an oxygen concentration sensor disposed in the exhaust pipe. A signal generated by the oxygen concentration sensor is converted into a first signal indicative of an air/fuel ratio in the engine cylinder. The fuel injector is operated to perform a fuel injection. A second signal indicative of an expected air/fuel ratio in the engine cylinder due to the fuel injection is generated and filtered to obtain a filtered signal, which is used to operate the engine. The filtered signal is obtained by periodically performing a control cycle including sampling a value of the first signal, sampling a value of the second signal, calculating a time constant as a function of the sampled value of the first signal, the sampled value of the second signal, and a value of the first signal sampled during a preceding control cycle, and calculating a value of the filtered second signal as a function of the calculated time constant, the sampled value of the second signal and a value of the filtered signal calculated during the preceding control cycle. This embodiment achieves essentially the same effects mentioned above, in particular that of automatically adapting and phasing the filtered signal with the signal of the oxygen concentration sensor.

According to an aspect of the solution, the value of the filtered signal may be calculated with the following equation:

$$x_{2if} = e^{-\frac{T}{\tau}} \cdot x_{2(i-1)f} + \left(1 - e^{-\frac{T}{\tau}}\right) \cdot x_{2i}$$

Wherein:

$\tau$ is the time constant, $x_{2if}$ is the value of the filtered signal, $x_{2(i-1)f}$ is the value of the filtered signal calculated during the preceding control cycle, $x_{2i}$ is the sampled value of the second signal, and T is a time period between two consecutive control cycles.

As a result, this aspect provides for calculating the value of the filtered signal with a so-called exponential filter, which is a simple and reliable solution for applying a first order filter to a signal.

According to another aspect of the solution, the time constant may be calculated with the following equation:

$$\tau = \frac{T}{\log \frac{x_{1i} - x_{2i}}{x_{1(i-1)} - x_{2i}}}$$

Wherein:

$\tau$ is the time constant, $x_{1i}$ is the sampled value of first signal, $x_{1(i-1)}$ is the sampled value of the first signal during the preceding control cycle, $x_{2i}$ is the sampled value of the second signal, and T is a time period between two consecutive control cycles.

This aspect provides a reliable solution for calculating the time constant to be used in the filter.

In another aspect of the solution, the method includes starting a closed-loop control strategy of a fuel injected quantity, as the value of filtered signal exceeds a predetermined threshold value thereof. Taking advantage of the reliability of the filtered signal provided by the present solution, this aspect allows a timely activation of the above mentioned closed-loop control strategy, which may be useful to prevent the generation of smoke and/or to properly execute a regeneration process of an aftertreatment device (for example of the ENT). This closed-loop control strategy may generally include calculating a difference between the first signal (generated with the aid the oxygen concentration sensor) and a target value thereof, using the calculated difference as an input of a controller, for example a proportional-integrative (PI) or a proportional-integrative-derivative (PID) controller, and using the output of the controller to adjusting a fuel quantity injected by the fuel injection.

According to another aspect of the present disclosure, the method may include starting a learning procedure of a fuel injected quantity, as the value of the filtered signal exceeds a predetermined threshold value thereof. Taking advantage of the reliability of the filtered signal provided by the present solution, this aspect allows a timely activation of the above mentioned learning procedure, which may be useful to correct one or more operation parameters of the fuel injector. This learning procedure may generally include the step of using the first signal (generated with the aid the oxygen concentration sensor) to estimate the fuel quantity that has been injected by means of a test fuel injection performed during an engine cut off.

According to another aspect of the present disclosure, the method may include starting a diagnostic strategy of an aftertreatment device located in the exhaust pipe upstream of the oxygen concentration sensor (for example the LNT), as the value of the filtered signal exceeds a predetermined threshold value thereof. Taking advantage of the reliability of the filtered signal provided by the present solution, this aspect allows a timely activation of the above mentioned diagnostic strategy, which may be useful to signal to the driver possible faults of the aftertreatment device. This diagnostic strategy may generally include calculating a difference between the first signal (generated with the aid the oxygen concentration sensor) and a set-point value thereof, and identify a fault of the aftertreatment device if the calculated difference exceeds a predetermined threshold value thereof.

Another embodiment of the present disclosure provides an apparatus for operating an internal combustion engine, the internal combustion engine including a fuel injector for injecting fuel into an engine cylinder, an exhaust pipe for discharging exhaust gas from the engine cylinder, an oxygen concentration sensor disposed in the exhaust pipe, the apparatus including an electronic control unit configured to convert a signal generated by the oxygen concentration sensor into a first signal indicative of an air/fuel ratio in the engine cylinder, operate the fuel injector to perform a fuel injection, generate a second signal indicative of an expected air/fuel ratio in the engine cylinder due to the fuel injection, filter the second signal to obtain a filtered signal, and use the filtered signal to operate the engine.

Filtering of the second signal may be periodically performed in a control cycle, in which the electronic control unit is configured to sample a value of the first signal, sample a value of the second signal, calculate a time constant as a function of the sampled value of the first signal, the sampled value of the second signal, and a value of the first signal sampled during a preceding control cycle, and calculate a value of the filtered second signal as a function of the calculated time constant, the sampled value of the second signal and a value of the filtered signal calculated during the preceding control cycle. This embodiment achieves essentially the same effects mentioned above, in particular that of automatically adapting and phasing the filtered signal with the signal of the oxygen concentration sensor.

According to an aspect of the solution, the electronic control unit may be configured to calculate the value of the filtered signal with the following equation:

$$x_{2if} = e^{-\frac{T}{\tau}} \cdot x_{2(i-1)f} + \left(1 - e^{-\frac{T}{\tau}}\right) \cdot x_{2i}$$

Wherein:

$\tau$ is the time constant, $x_{2if}$ is the value of the filtered signal, $x_{2(i-1)f}$ is the value of the filtered signal calculated during the preceding control cycle, $x_{2i}$ is the sampled value of the second signal, and T is a time period between two consecutive control cycles.

As a result, this aspect provides for calculating the value of the filtered signal with a so-called exponential filter, which is a simple and reliable solution for applying a first order filter to a signal.

According to another aspect of the solution, the electronic control unit may be configured to calculate the time constant with the following equation:

$$\tau = \frac{T}{\log \frac{x_{1i} - x_{2i}}{x_{1(i-1)} - x_{2i}}}$$

Wherein:

$\tau$ is the time constant, $x_{1i}$ is the sampled value of first signal, $x_{1(i-1)}$ is the sampled value of the first signal during the preceding control cycle, $x_{2i}$ is the sampled value of the second signal, and T is a time period between two consecutive control cycles.

This aspect provides a reliable solution for calculating the time constant to be used in the filter.

Another aspect of the solution provides that the electronic control unit may be configured to start a closed-loop control strategy of a fuel injected quantity, as the value of filtered signal exceeds a predetermined threshold value thereof. Taking advantage of the reliability of the filtered signal provided by the present solution, this aspect allows a timely activation of the above mentioned closed-loop control strategy, which may be useful to prevent the generation of smoke and/or to properly execute a regeneration process of an aftertreatment device (for example of the LNT). Using a closed-loop control strategy, the electronic control unit may generally be configured as a controller to calculate a difference between the first signal (generated with the aid of the oxygen concentration sensor) and a target value thereof, use the calculated difference as an input to the controller, for example a proportional-integrative (PI) or a proportional-integrative-derivative (PID) controller, and use the output of the controller to adjusting a fuel quantity injected by the fuel injection.

According to another aspect of the present disclosure, the electronic control unit may be configured to start a learning procedure of a fuel injected quantity, as the value of the filtered signal exceeds a predetermined threshold value thereof. Taking advantage of the reliability of the filtered signal provided by the present solution, this aspect allows a timely activation of the above mentioned learning procedure, which may be useful to correct one or more operation parameters of the fuel injector. This learning procedure may generally involve means for using the first signal (generated with the aid of the oxygen concentration sensor) to estimate the fuel quantity that has been injected by means of a test fuel injection performed during an engine cut off.

According to another aspect of the present disclosure, the electronic control unit may be configured to start a diagnostic strategy of an aftertreatment device located in the exhaust pipe upstream of the oxygen concentration sensor (for example the LNT), as the value of the filtered signal exceeds a predetermined threshold value thereof. Taking advantage of the reliability of the filtered signal provided by the present solution, this aspect allows a timely activation of the above mentioned diagnostic strategy, which may be useful to signal to the driver possible faults of the aftertreatment device. This diagnostic strategy may generally be executed by the electronic control unit configured to calculate a difference between the first signal (generated with the aid of the oxygen concentration sensor) and a set-point value thereof, and identify a fault of the aftertreatment device if the calculated difference exceeds a predetermined threshold value thereof.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

Figure 1:
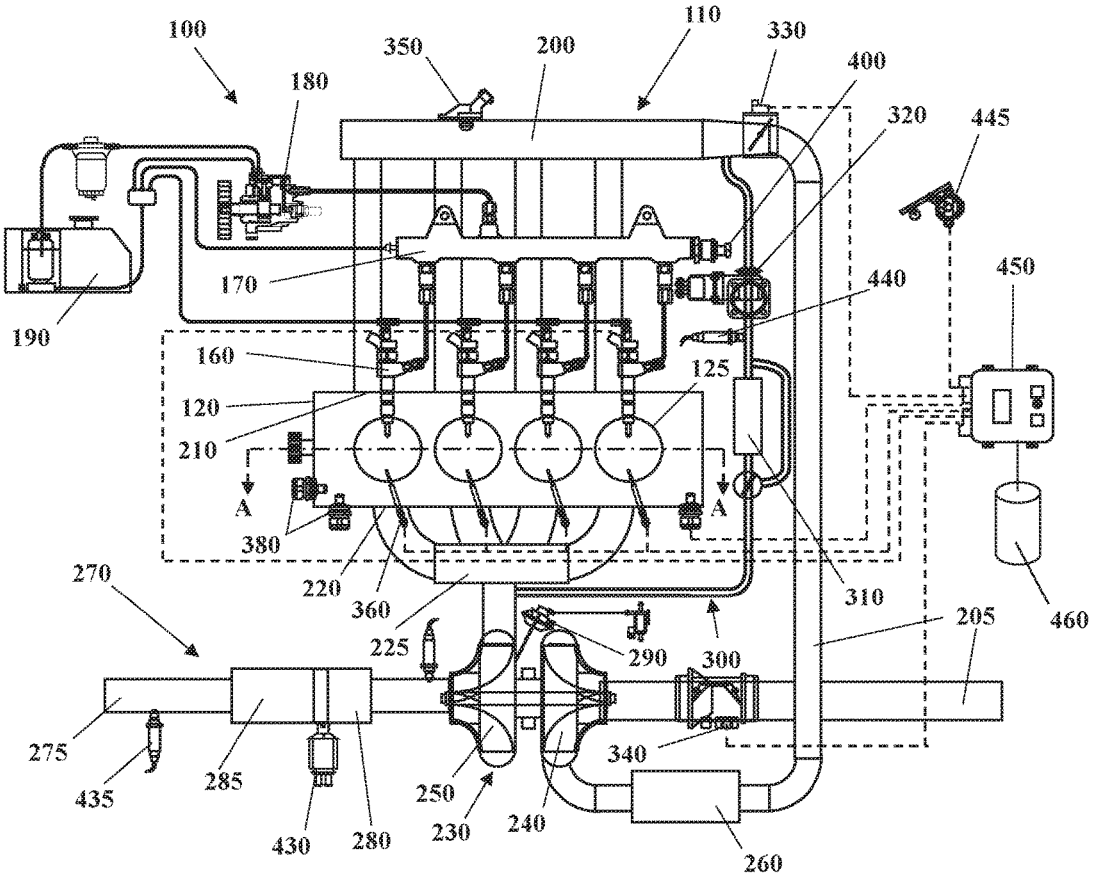
FIG. 1 is a schematic representation of an automotive system according to an embodiment of the present solution.
Figure 2:
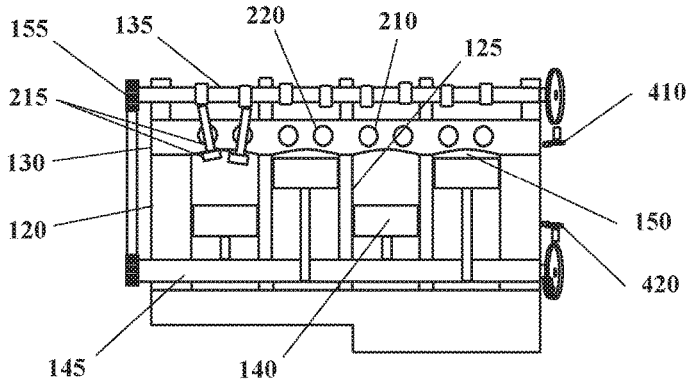
FIG. 2 is the section A-A of the internal combustion engine belonging to the automotive system of FIG. 1.

Some embodiments may include an automotive system 100, as shown in FIGS. 1 and 2, that includes an internal combustion engine (ICE) 110 having an engine block 120 defining at least one cylinder 125 having a piston 140 coupled to rotate a crankshaft 145. A cylinder head 130 cooperates with the piston 140 to define a combustion chamber 150. A fuel and air mixture (not shown) is disposed in the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a high pressure fuel pump 180 that increase the pressure of the fuel received from a fuel source 190. Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust gases exit the turbine 250 and are directed into an exhaust system 270. The exhaust system 270 may include an exhaust pipe 275 having one or more exhaust aftertreatment devices. The aftertreatment devices may be any device configured to change the composition of the exhaust gases. Some examples of aftertreatment devices include, but are not limited to, catalytic converters (two and three way), oxidation catalysts (DOC), lean NOx traps (LNT), hydrocarbon adsorbers, selective catalytic reduction (SCR) systems, and particulate filters (DPF). In the present example, the aftertreatment devices may particularly include a LNT 280 coupled to an oxidation catalyst and a DPF 285 located downstream of the LNT 280. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The automotive system 100 may further include an electronic control unit (ECU) 450 in communication with one or more sensors and/or devices associated with the ICE 110. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, exhaust pressure and temperature sensors 430, an oxygen concentration sensor 435 (e.g. a lambda sensor or a $NO_x$ sensor), an EGR temperature sensor 440, and an accelerator pedal position sensor 445. The oxygen concentration sensor 435 is located in the exhaust pipe 275, for example downstream of the LNT 280, and is configured to generate a signal (e.g. electric signal) indicative of the oxygen concentration in the exhaust gas. Furthermore, the ECU 450 may generate output signals to various control devices that are arranged to control the operation of the ICE 110, including, but not limited to, the fuel injectors 160, the throttle body 330, the EGR Valve 320, the VGT actuator 290, and the cam phaser 155. Note, dashed lines are used to indicate communication between the ECU 450 and the various sensors and devices, but some are omitted for clarity.

Turning now to the ECU 450, this apparatus may include a digital central processing unit (CPU) in communication with a memory system and an interface bus. The CPU is configured to execute instructions stored as a program in the memory system 460, and send and receive signals to/from the interface bus. The memory system 460 may include various storage types including optical storage, magnetic storage, solid state storage, and other non-volatile memory. The interface bus may be configured to send, receive, and modulate analog and/or digital signals to/from the various sensors and control devices. The program may embody the methods disclosed herein, allowing the CPU to carryout out the steps of such methods and control the ICE 110.

The program stored in the memory system 460 is transmitted from outside via a cable or in a wireless fashion. Outside the automotive system 100 it is normally visible as a computer program product, which is also called computer readable medium or machine readable medium in the art, and which should be understood to be a computer program code residing on a carrier, the carrier being transitory or non-transitory in nature with the consequence that the computer program product can be regarded to be transitory or non-transitory in nature.

An example of a transitory computer program product is a signal, e.g. an electromagnetic signal such as an optical signal, which is a transitory carrier for the computer program code. Carrying such computer program code can be achieved by modulating the signal by a conventional modulation technique such as QPSK for digital data, such that binary data representing the computer program code is impressed on the transitory electromagnetic signal. Such signals are e.g. made use of when transmitting computer program code in a wireless fashion via a WiFi connection to a laptop.

In case of a non-transitory computer program product the computer program code is embodied in a tangible storage medium. The storage medium is then the non-transitory carrier mentioned above, such that the computer program code is permanently or non-permanently stored in a retrievable way in or on this storage medium. The storage medium can be of conventional type known in computer technology such as a flash memory, an Asic, a CD or the like.

Instead of an ECU 450, the automotive system 100 may have a different type of processor to provide the electronic logic, e.g. an embedded controller, an onboard computer, or any processing module that might be deployed in the vehicle.

Figure 3:
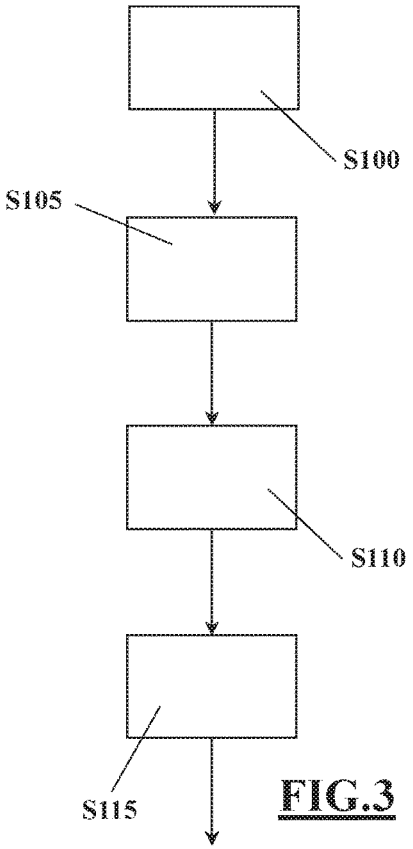
FIG. 3 is a flowchart representing a strategy implemented by an electronic control unit of the automotive system for generating a signal indicative of an air/fuel ratio that fits the signal coming from an oxygen concentration sensor.

As schematically represented in the flowchart of FIG. 3, the ECU 450 may be generally configured to continuously receive the signal generated by the oxygen concentration sensor 435 and to convert it (block 100) into a first signal $EqR_{sensor}$ representative of an air-to-fuel ratio (A/F) of the mixture ignited within the combustion chambers 150 of the ICE 110. In particular, the values of the first signal $EqR_{sensor}$ generated by ECU 450 with the aid of the oxygen concentration sensor 435 may be values of an equivalent ratio EqR, which is expressed according to the following formula:

$$EqR = \frac{1}{\lambda}$$

wherein λ is the lambda parameter defined as:

$$\lambda = \frac{A/F}{\alpha_{stoich}}$$

wherein A/F is the air-to-fuel ratio and $\alpha_{stoich}$ is the air-to-fuel stoichiometric ratio.

While generating the first signal $EqR_{sensor}$, the ECU 450 may be also generally configured to operate a fuel injector 160 to perform a fuel injection into the corresponding combustion chamber 150 (block S105). In particular, the ECU 450 may be configured to determine a value of a fuel quantity to be injected in the combustion chamber 150 on the basis of a number of engine operating parameters, including for example the position of the accelerator pedal sensed by the sensor 445, and then to operate the fuel injector 160 accordingly.

Based on the value of the fuel injected quantity, the ECU 450 may be further configured to generate a second signal $EqR_{ECU}$ representative of an expected air/fuel equivalent ratio inside the combustion chamber 150 due to the fuel injection (block S110). In order to generate the second signal $EqR_{ECU}$, the ECU 450 may be configured to determine the value of the fuel injected quantity (in terms of a mass) as explained above, to determine a value of an air quantity (in terms of a mass) entering the combustion chamber 150 during the engine cycle in which the fuel injection is performed, and to calculate a value of the air/fuel ratio as the ratio between the determined value of the air quantity and the determined value of the fuel injected quantity.

Figure 5:
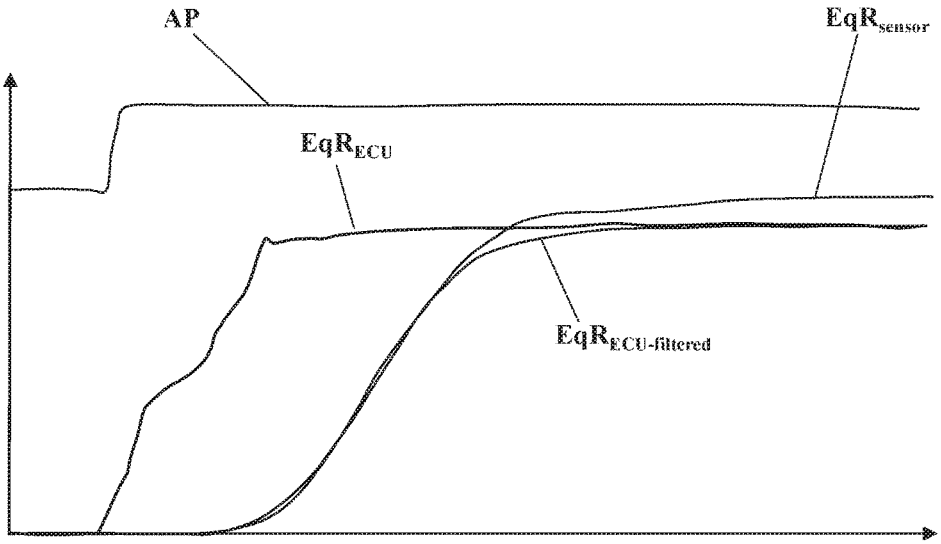
FIG. 5 is a diagram showing the variation over the time of the accelerator pedal position, of a raw signal of the air/fuel ratio generated by the electronic control unit, of a signal generated by the oxygen concentration sensor and of a filtered signal obtained from the raw signal.

The value of the air quantity may be determined by the ECU 450 (e.g. calculated or estimated) on the basis of the measurement made by the mass airflow and temperature sensor 340. In this way, supposing to have an abrupt variation of the accelerator pedal position AP as shown in FIG. 5, which corresponds to an abrupt increment of the fuel injected quantity, the ECU 450 will generate a second signal $EqR_{ECU}$ having a corresponding abrupt variation over the time. However, the second signal $EqR_{ECU}$ will not generally correspond to the first signal $EqR_{sensor}$ generated with the aid of the oxygen concentration sensor 435, because the first signal $EqR_{sensor}$ is affected by the delay with which the exhaust gas, produced by the injected fuel quantity, reaches the oxygen concentration sensor 435 and by the dynamics with which the oxygen concentration sensor 435 responds to the variation of the oxygen concentration in the exhaust gas.

Figure 4:
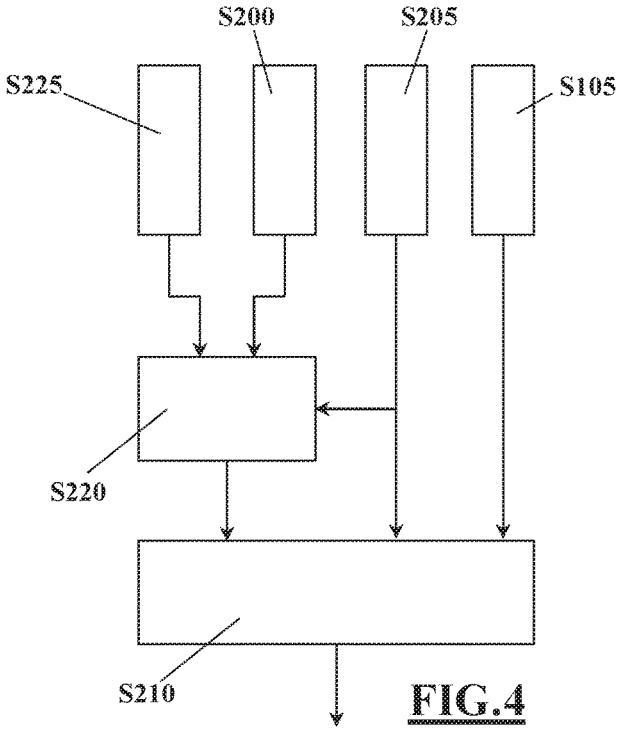
FIG. 4 is a flowchart representing a recursive control cycle involved in the strategy of FIG. 3.

For this reason, the ECU 450 may be configured to filter in real time the second signal $EqR_{ECU}$ (block S115) by means of an exponential filter whose time constant changes on the basis of the first signal $EqR_{sensor}$ of the oxygen concentration sensor 435, in order to yield a filtered signal $EqR_{ECU\text{-}filtered}$ that is automatically phased and shaped as the first signal $EqR_{sensor}$. This filtering process may be performed by periodically repeating the control cycle represented in FIG. 4. This control cycle may be repeated at high frequency, for example with a predetermined time period T between two consecutive cycles that may be smaller than 30 ms (milliseconds) or even smaller than 10 ms.

The control cycle (i) provides for the ECU 450 to sample a current value of the first signal $EqR_{sensor}$ generated with the aid of the oxygen concentration sensor 435 (block S200) and a current value $x_{2i}$ of the second signal $EqR_{ECU}$ estimated by the ECU 450 (block S205). The current value $x_{2i}$ of the second signal $EqR_{ECU}$ may then be used (block S210) to calculate a current value $x_{2if}$ of the filtered signal $EqR_{ECU\text{-}filtered}$ according to the following equation of the exponential filter:

$$x_{2if} = e^{-\frac{T}{\tau}} \cdot x_{2(i-1)f} + \left(1 - e^{-\frac{T}{\tau}}\right) \cdot x_{2i}$$

wherein:

$x_{2(i-1)f}$ is the value of the filtered signal $EqR_{ECU\text{-}filtered}$ as calculated during the last preceding control cycle (i−1), T is the time period between two consecutive control cycles, and τ is the time constant of the filter.

The value $x_{2(i-1)f}$ of the filtered signal $EqR_{ECU\text{-}filtered}$ may be retrieved (block S215) by the ECU 450 from a memory system and updated, at the end of each control cycle, with the last calculated value $x_{2if}$ of the filtered signal $EqR_{ECU\text{-}filtered}$.

The time constant τ of the filter may be calculated (block S220) with an equation which is derived from the equation of the exponential filter, but inverting the unknown parameters:

$$\tau = \frac{T}{\log \frac{x_{1i} - x_{2i}}{x_{1(i-1)} - x_{2i}}}$$

Wherein:

$x_{1i}$ is the current value of first signal $EqR_{sensor}$, $x_{1(i-1)}$ is the value of the first signal $EqR_{sensor}$ during the last preceding control cycle, $x_{2i}$ is the current value of the second signal $EqR_{ECU}$, and T is the time period between two consecutive control cycles.

The value $x_{1(i-1)}$ of the first signal $EqR_{sensor}$ may be retrieved (block S225) by the ECU 450 from a memory system and updated, at the end of each control cycle, with the last sampled value $x_{1i}$ of the first signal $EqR_{sensor}$.

The macroscopic effect of this recursive control cycle can be appreciated by looking at FIG. 5. As long as the second signal $EqR_{ECU}$ changes but the first signal $EqR_{sensor}$ remains constant, the calculated time constant τ will be extremely high, thereby keeping the filtered signal $EqR_{ECU\text{-}filtered}$ constant. When the first signal $EqR_{sensor}$ starts varying, the time constant τ becomes lower allowing the filtered signal $EqR_{ECU\text{-}filtered}$ to follow the sensor response. During the transient phase of the first signal $EqR_{sensor}$, time constant τ is continuously adjusted and applied to the second signal $EqR_{ECU}$, thereby generating a filtered signal $EqR_{ECU\text{-}filtered}$ that automatically reaches the same steady state value of the second signal $EqR_{ECU}$ with the same dynamics of the first signal $EqR_{sensor}$, including the delay in the response. The filtered signal $EqR_{ECU\text{-}filtered}$ may be involved in many different engine control strategies that use the oxygen concentration sensor 435.

By way of example, during the normal operation of the ICE 110, when the value $x_{2if}$ of the filtered signal $EqR_{ECU\text{-}filtered}$ exceeds a predetermined threshold value thereof, the ECU 450 may be configured to start a closed-loop control strategy of the fuel quantity injected by the fuel injector 160. This closed-loop control strategy may generally include the steps of sampling a value of the first signal $EqR_{sensor}$ generated with the aid of the oxygen concentration sensor 435, calculating a difference between the sampled value of the first signal $EqR_{sensor}$ and a target value thereof, using the calculated difference (error) as an input of a controller, for example a proportional-integrative (PI) or a proportional-integrative-derivative (PID) controller, and using the output of the controller to adjust the fuel quantity injected by the fuel injection, in such away to minimize the calculated error.

In addition or as an alternative, the filtered signal $EqR_{ECU\text{-}filtered}$ may be used while the ICE 110 is operating under a cut-off condition, in order to evaluate the efficiency of a fuel injector 160 that has been commanded to perform a small injection, namely an injection of a small quantity of fuel. In this case, when the value $x_{2if}$ of the filtered signal $EqR_{ECU\text{-}filtered}$ exceeds a predetermined threshold value thereof, the ECU 450 may be configured to start a learning procedure of the fuel injected quantity, which generally provides for sampling a value of the first signal $EqR_{sensor}$ generated with the aid of the oxygen concentration sensor 435 and for using the sampled value to estimate the fuel quantity that has been injected.

The difference between the estimated value of the fuel injected quantity and an expected value thereof may be used to correct the actuation of the fuel injector 160 during the operation of the ICE 110.

In addition or as an alternative, the filtered signal $EqR_{ECU\text{-}filtered}$ may be used to diagnose the efficiency of one of the aftertreatment devices located in the exhaust pipe 275 upstream of the oxygen concentration sensor 435, for example the efficiency of the LNT 280. In this case, after that the ECU 450 has commanded a predetermined fuel injection, when the value $x_{2if}$ of the filtered signal $EqR_{ECU\text{-}filtered}$ exceeds a predetermined threshold value thereof, the ECU 450 may be configured to start a diagnostic procedure which generally includes the steps of sampling a value of the first signal $EqR_{sensor}$ generated with the aid of the oxygen concentration sensor 435, calculating a difference between the sampled value of the first signal $EqR_{sensor}$ and a set-point value thereof, and identify a fault of the aftertreatment device if the calculated difference exceeds a predetermined threshold value thereof. Any fault of the aftertreatment system may be signaled by the ECU 450 to a driver of the automotive system 100, for example by turning on a warning light in a dashboard of the automotive system 100.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A non-transitory computer readable medium comprising computer program having program code, which when executed on a computer is configured to:

convert a signal generated by an oxygen concentration sensor into a first signal indicative of an air/fuel ratio in an engine cylinder;

operate a fuel injector to perform a fuel injection into the engine cylinder;

generate a second signal indicative of an expected air/fuel ratio in the engine cylinder due to the fuel injection;

filter the second signal to obtain a filtered signal; and use the filtered signal to operate the engine;

wherein the filtered signal is obtained by periodically performing a control cycle including:

sampling a value of the first signal;

sampling a value of the second signal;

calculating a time constant as a function of the sampled value of the first signal, the sampled value of the second signal, and a value of the first signal sampled during a preceding control cycle; and calculating a value of the filtered signal as a function of the calculated time constant, the sampled value of the second signal and a value of the filtered signal calculated during the preceding control cycle, including calculating the value of the filtered signal according to:

$$x_{2if} = e^{-\frac{T}{\tau}} \cdot x_{2(i-1)f} + \left(1 - e^{-\frac{T}{\tau}}\right) \cdot x_{2i}$$

wherein $\tau$ is the time constant, $x_{2if}$ is the value of the filtered signal, $x_{2(i-1)f}$ is the value of the filtered signal calculated during the preceding control cycle, $x_{2i}$ is the sampled value of the second signal, and T is a time period between two consecutive control cycles.

2. The non-transitory computer readable medium according to claim 1, wherein the time constant is calculated with the following equation:

$$\tau = \frac{T}{\log \frac{x_{1i} - x_{2i}}{x_{1(i-1)} - x_{2i}}}$$

wherein $\tau$ is the time constant, $x_{1i}$ is the sampled value of first signal, $x_{1(i-1)}$ is the sampled value of the first signal during the preceding control cycle, $x_{2i}$ is the sampled value of the second signal, T is a time period between two consecutive control cycles.

3. The non-transitory computer readable medium according to claim 1, further comprising computer program having program code, which when executed on a computer is configured to start a closed-loop control strategy of a fuel injected quantity, as the value of filtered signal exceeds a predetermined threshold value thereof.

4. The non-transitory computer readable medium according to claim 1, further comprising computer program having program code, which when executed on a computer is configured to start a learning procedure of a fuel injected quantity, as the value of the filtered signal exceeds a predetermined threshold value thereof.

5. The non-transitory computer readable medium according to claim 1 further comprising computer program having program code, which when executed on a computer is configured to start a diagnostic strategy of an aftertreatment device located in an exhaust pipe upstream of the oxygen concentration sensor, as the value of the filtered signal exceeds a predetermined threshold value thereof.

6. An internal combustion engine comprising a fuel injector for injecting fuel into an engine cylinder, an exhaust pipe for discharging exhaust gas from the engine cylinder, an oxygen concentration sensor disposed in the exhaust pipe for generating the first signal indicative of an air/fuel ratio in the engine cylinder, and an electronic control unit configured to execute the computer program according claim 1.

7. A method for operating an internal combustion engine comprising:

converting a signal generated by an oxygen concentration sensor into a first signal indicative of an air/fuel ratio in an engine cylinder;

operating a fuel injector to perform a fuel injection into the engine cylinder;

generating a second signal indicative of an expected air/fuel ratio in the engine cylinder due to the fuel injection;

filtering the second signal to obtain a filtered signal; and using the filtered signal to operate the engine;

wherein the filtered signal is obtained by periodically performing a control cycle including:

sampling a value of the first signal;

sampling a value of the second signal;

calculating a time constant as a function of the sampled value of the first signal, the sampled value of the second signal, and a value of the first signal sampled during a preceding control cycle; and calculating a value of the filtered signal as a function of the calculated time constant, the sampled value of the second signal and a value of the filtered signal calculated during the preceding control cycle, including calculating the value of the filtered signal according to:

$$x_{2if} = e^{-\frac{T}{\tau}} \cdot x_{2(i-1)f} + \left(1 - e^{-\frac{T}{\tau}}\right) \cdot x_{2i}$$

wherein $\tau$ is the time constant, $x_{2if}$ is the value of the filtered signal, $x_{2(i-1)f}$ is the value of the filtered signal calculated during the preceding control cycle, $x_{2i}$ is the sampled value of the second signal, T is a time period between two consecutive control cycles.

8. The method according to claim 7, wherein the time constant is calculated with the following equation:

$$\tau = \frac{T}{\log \frac{x_{1i} - x_{2i}}{x_{1(i-1)} - x_{2i}}}$$

wherein $\tau$ is the time constant, $x_{1i}$ is the sampled value of first signal, $x_{1(i-1)}$ is the sampled value of the first signal during the preceding control cycle, $x_{2i}$ is the sampled value of the second signal, T is a time period between two consecutive control cycles.

9. The method according to claim 7, further comprising starting a closed-loop control strategy of a fuel injected quantity, as the value of filtered signal exceeds a predetermined threshold value thereof.

10. The method according to claim 7, further comprising starting a learning procedure of a fuel injected quantity, as the value of the filtered signal exceeds a predetermined threshold value thereof.

11. The method according to claim 7, further comprising starting a diagnostic strategy of an aftertreatment device located in an exhaust pipe upstream of the oxygen concentration sensor, as the value of the filtered signal exceeds a predetermined threshold value thereof.

* * * * *